US011105168B2

(12) United States Patent
Sherman

(10) Patent No.: US 11,105,168 B2
(45) Date of Patent: Aug. 31, 2021

(54) DISSOLVABLE PRESSURE BARRIER

(71) Applicant: ADVANCED UPSTREAM LTD., Calgary (CA)

(72) Inventor: Scott Sherman, Blackie (CA)

(73) Assignee: Advanced Upstream Ltd., Calgary (CA)

( * ) Notice: Subject to any disclaimer, the term of this patent is extended or adjusted under 35 U.S.C. 154(b) by 81 days.

(21) Appl. No.: 16/543,326

(22) Filed: Aug. 16, 2019

(65) Prior Publication Data

US 2020/0056435 A1 Feb. 20, 2020

Related U.S. Application Data

(60) Provisional application No. 62/734,453, filed on Sep. 21, 2018, provisional application No. 62/719,009, filed on Aug. 16, 2018.

(51) Int. Cl.

| | |
|---|---|
| ***E21B 29/02*** | (2006.01) |
| ***E21B 34/06*** | (2006.01) |
| ***E21B 33/12*** | (2006.01) |
| ***E21B 41/00*** | (2006.01) |

(52) U.S. Cl.

CPC ..... *E21B 29/02* (2013.01); *E21B 33/1208* (2013.01); *E21B 34/063* (2013.01); *E21B 41/0085* (2013.01)

(58) Field of Classification Search

CPC ..... E21B 29/02; E21B 2200/08; E21B 33/00; E21B 33/128; E21B 33/1208; E21B 34/063; E21B 41/0085

See application file for complete search history.

(56) References Cited

U.S. PATENT DOCUMENTS

| | | | | |
|---|---|---|---|---|
| 4,157,732 | A * | 6/1979 | Fonner | E21B 41/00 166/376 |
| 2008/0135249 | A1* | 6/2008 | Fripp | E21B 43/088 166/285 |
| 2013/0081814 | A1* | 4/2013 | Gaudette | E21B 23/00 166/297 |
| 2014/0352945 | A1 | 12/2014 | Danait et al. | |
| 2014/0353042 | A1 | 12/2014 | Karale et al. | |
| 2014/0374099 | A1 | 12/2014 | Wagle et al. | |
| 2016/0230075 | A1 | 8/2016 | Wagle et al. | |
| 2018/0100367 | A1 | 4/2018 | Perez | |
| 2018/0171738 | A1 | 6/2018 | Xu et al. | |
| 2018/0238133 | A1* | 8/2018 | Fripp | C22C 21/00 |
| 2018/0283121 | A1 | 10/2018 | Zhang et al. | |
| 2018/0283141 | A1 | 10/2018 | Zhang et al. | |
| 2018/0283142 | A1* | 10/2018 | Zhang | E21B 41/02 |

* cited by examiner

*Primary Examiner* — David Carroll

(74) *Attorney, Agent, or Firm* — McCarthy Tétrault LLP

(57) ABSTRACT

A dissolvable pressure barrier comprises a body having metallic dissolvable components, a power source, and a connector that is shiftable from a first position to a second position when a pressure greater than a predetermined load is applied to the pressure barrier. In the first position, the connector is electrically insulated from the power source. In the second position, the connector is in electrical communication with the power source, the metallic dissolvable components, and the casing of the wellbore, thereby forming an electric circuit wherein a voltage is provided by the power source and the dissolution of the pressure barrier is accelerated by an anodic process. The metallic dissolvable components may be coated with a low activity metal to assist with the dissolution process.

18 Claims, 2 Drawing Sheets

DISSOLVABLE PRESSURE BARRIER

CROSS-REFERENCE TO RELATED APPLICATIONS

This application claims the benefit of U.S. Provisional Application No. 62/719,009, filed Aug. 16, 2018, and of U.S. Provisional Application No. 62/734,453, filed Sep. 21, 2018, the contents of which are hereby incorporated by reference in their entireties.

FIELD

The present disclosure relates to a pressure barrier for use in downhole operations and more particularly to a pressure barrier that is dissolvable after use under various downhole conditions.

BACKGROUND

A wide variety of downhole tools may be used within a wellbore in connection with producing hydrocarbons or reworking a well that extends into a hydrocarbon formation. Downhole tools such as frac plugs, bridge plugs, packers, etc. (all of which may be generally referred to as "pressure barriers") may be used to direct flow into or out of perforations through casing along the wellbore or to isolate one pressure zone of the formation from another. Such downhole tools are well known in the art.

After the intervention, stimulation, or reworking operation is complete, these downhole tools must be removed from the wellbore. Downhole tool removal has conventionally been accomplished by complex retrieval operations, or by milling or drilling the downhole tool out of the wellbore mechanically. Thus, downhole tools are either permanent, retrievable or disposable. Disposable downhole tools have traditionally been formed of drillable metal materials such as cast iron, brass and aluminum. Milling and drilling are time consuming and expensive operations. To reduce the milling or drilling time, the next generation of downhole tools comprises polymers and other nonmetallic materials, such as engineering grade plastics or composites. A subset of these materials is degradable under certain conditions, usually in the presence of water or brine at elevated temperature, such as 65° C. or higher. When cooler conditions exist in a wellbore the degrading reaction may occur slowly, or not at all.

Existing dissolvable pressure barriers generally fall into two categories: (i) metal pressure barriers comprised of magnesium alloy; and (ii) polymer pressure barriers comprised of polyglycolic acid (PGA), polyvinyl acetate (PVA), polylactic acid (PLA), a copolymer comprised of PGA and PLA (PGLA), or other polymers that readily dissolve in water.

For metal pressure barriers to dissolve, the wellbore fluids must comprise brine so the salt ions in the brine form an aqueous electrolyte, whereby the magnesium pressure barrier becomes the anode and the steel wellbore casing becomes the cathode in an electrolytic reaction. Over time, the magnesium ($Mg^{2+}$) ions become aqueous and flow out of the wellbore with the wellbore fluids or plate out inside the casing. This process is known in the art as cathodic protection and is used to protect steel pipelines and marine equipment. Drawing a parallel to cathodic protection techniques, the magnesium downhole tool acts as the sacrificial anode.

For polymer pressure barriers, the temperature of the downhole water greatly influences the rate of dissolution. Commercially available polymer-based pressure barriers require that the water temperature be at least 65° C. to obtain an acceptable dissolution rate of 1 to 2 weeks. The pH level of the water can also impede the dissolution of the polymer pressure barriers. If the pH level of the water is above 9, the polymer pressure barriers may not dissolve.

The polymers in polymer-based pressure barriers degrade by hydrolysis whereby naturally occurring lactic acid is formed. Degradation of the polymers starts with water uptake, followed by random cleavage of the ester bonds in the polymer chain. The degradation takes place within the plastic structure. Upon degradation, the number of carboxylic end groups increases, which leads to a decrease in pH which further increases the rate of degradation.

Therefore, a need exists for disposable downhole tools that are removable without being milled or drilled out of the wellbore and are degradable in cooler conditions in the presence of wellbore fluids with varying pH levels.

SUMMARY

According to a broad aspect of the present disclosure, there is provided a method for dissolving at least a part of a pressure barrier in a wellbore having a casing, the pressure barrier comprising a power source and one or more metallic dissolvable components, the method comprising the step of applying a voltage, by the power source, across the casing and the pressure barrier.

In some embodiments, the method comprises the step of, prior to applying the voltage, applying a pressure to the pressure barrier.

In some embodiments, the pressure barrier comprises a connector, and wherein applying the pressure to the pressure barrier shifts the connector from a first position, wherein the connector is electrically insulated from the power source, to a second position, wherein the connector is in electrical communication with the power source, the metallic dissolvable components, and the casing.

In some embodiments, the connector is held in place by a retaining mechanism that fails upon application of a predetermined load thereon and the pressure is the same or greater than the predetermined load. In some embodiments, the predetermined load ranges from about 100 lbs to about 500 lbs.

In some embodiments, at least one of the one or more metallic dissolvable components is coated with a low activity metal.

In some embodiments, the method comprises the step of delaying application of the voltage for a predetermined amount of time.

In some embodiments, the method comprises the step of releasing, by the pressure barrier, a corrosive agent.

In some embodiments, the voltage is between about 1 volt and about 5 volts.

According to another broad aspect of the present disclosure, there is provided a pressure barrier for downhole operations comprising: a body having a metallic dissolvable component; a power source; a connector, the connector being conductive and electrically connected to the metallic dissolvable component, the connector configured to fluidly seal the power source from downhole fluids, and the connector having: a first position, wherein the connector is electrically insulated from the power source; and a second position, wherein the connector is in electrical communication with the power source; and wherein the connector is shiftable from the first position to the second position when a pressure above a predetermined load is applied to the pressure barrier.

In some embodiments, at least a part of an outer surface of the metallic dissolvable component is coated with a low activity metal.

In some embodiments, the low activity metal comprises gold, platinum, copper, silver, or a combination thereof.

In some embodiments, the pressure barrier comprises a retaining mechanism for maintaining the connector in the first position and the retaining mechanism is configured to fail when the pressure is above the predetermined load.

In some embodiments, the metallic dissolvable component comprises one or more of: zinc, magnesium, lithium, gallium, aluminum, and an alloy thereof.

In some embodiments, the connector comprises a magnesium alloy, an aluminum alloy, or a combination thereof.

In some embodiments, the power source comprises one or more of a battery, a capacitor, and an electrochemical cell.

In some embodiments, the pressure barrier comprises slips, a slip body, and a shoe, wherein at least one of the slips, slip body, and shoe comprises the metallic dissolvable component.

In some embodiments, the pressure barrier comprises a bladder having a corrosive agent therein and configured to release the corrosive agent when the connector is in the second position.

In some embodiments, the connector is a sealing member, wherein in the first position, the sealing member is physically separated from the power source and in the second position, the sealing member is shifted downward to be in physical contact with the power source.

The details of one or more embodiments are set forth in the description below. Other features and advantages will be apparent from the specification and the claims.

BRIEF DESCRIPTION OF THE DRAWINGS

The invention will now be described by way of an exemplary embodiment with reference to the accompanying simplified, diagrammatic, not-to-scale drawings. Any dimensions provided in the drawings are provided only for illustrative purposes, and do not limit the invention as defined by the claims. In the drawings:

FIG. 1A shows a connector of the pressure barrier in a first position and FIG. 1B shows the connector in a second position.

DETAILED DESCRIPTION OF THE EMBODIMENTS

When describing the present invention, all terms not defined herein have their common art-recognized meanings. To the extent that the following description is of a specific embodiment or a particular use of the invention, it is intended to be illustrative only, and not limiting of the claimed invention. The following description is intended to cover all alternatives, modifications and equivalents that are included in the scope of the invention, as defined in the appended claims.

According to embodiments herein, dissolution of a pressure barrier is driven by an internal electromotive force and an anodic process is used to accelerate the dissolution. The anodic process is opposite to the cathodic protection technique for preventing corrosion. In particular, the methods and pressure barrier disclosed herein aim to accelerate the corrosion of metallic components of the pressure barrier by application of a voltage across the casing and the pressure barrier.

In some embodiments, the pressure barrier comprises a power source to selectively apply a voltage across the casing and the pressure barrier itself. In some embodiments, the power source comprises one or more of: a battery, a capacitor, and an electrochemical reactor. In some embodiments, the voltage applied is low voltage DC power. In some embodiments, the voltage ranges from about 1 volt to about 5 volts. In one embodiment, the voltage is about 1.5 V.

In some embodiments, some components (for example, slips, packer retainer rings, shoe, etc.) of the pressure barrier are electroplated or otherwise coated with low activity metals, such as gold, platinum, copper, silver, and the like. The presence of low activity metals may accelerate the electrochemical dissolution of metallic dissolvable components of the pressure barrier.

In some embodiments, when pressure is applied to the pressure barrier during or after a wellbore operation (for example, fracking operations), the dissolution process is initiated. In further embodiments, the start of the dissolution process may be delayed by electrical or chemical methods to help ensure that the pressure barrier does not begin dissolving until after the wellbore operation is completed. For example, the dissolution process may be delayed using a timer. In another example, the dissolution process may be delayed using a switch that can be actuated by detection of downhole pressure signals.

In some embodiments, the pressure barrier may further comprise a bladder containing a corrosive agent. Once the dissolution process begins, the corrosive agent is released to further accelerate the corrosion of the dissolvable metal components of the pressure barrier.

Figure 1B:
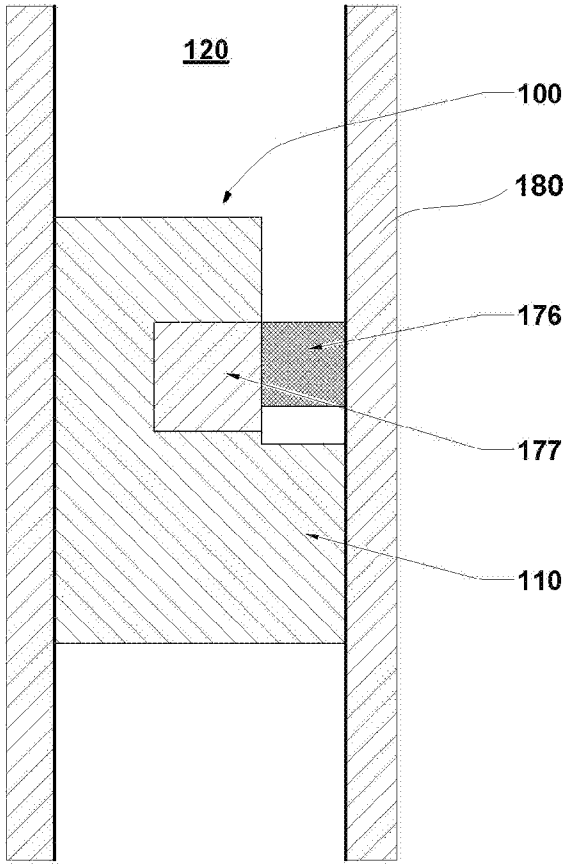
FIG. 1A and FIG. 1B are schematic views of a pressure barrier according to an embodiment of the present disclosure.
Figure 1A:
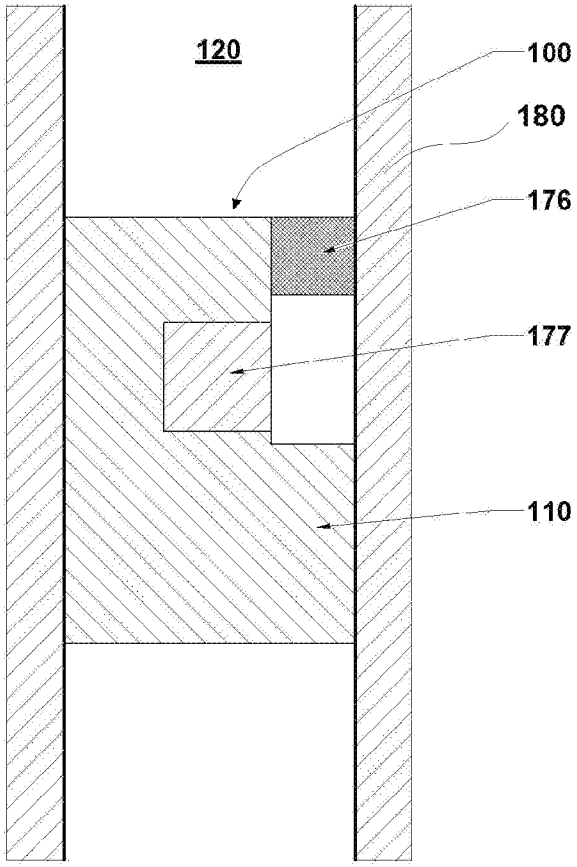

With reference to FIGS. 1A and 1B, a pressure barrier 100 usable in a wellbore 120 for wellbore operations comprises a body 110, a power source 177 and a movable connector 176. In the illustrated embodiment, the wellbore 120 is cased with a casing 180.

One or more components of the pressure barrier 100, or portions thereof, are formed from dissolvable materials. More specifically, the pressure barrier 100 or a component thereof comprises an effective amount of degradable material such that the pressure barrier 100 or the component desirably degrades when exposed to a wellbore environment, as further described below. In particular, the degradable material dissolves in the presence of an aqueous fluid in a wellbore environment. A fluid is considered to be "aqueous" herein if the fluid comprises any amount of water. The dissolvable components of the pressure barrier 100 may be formed of any material that is suitable for service in a downhole environment and that provides adequate strength to enable proper operation of the pressure barrier 100. The particular material matrix used to form the dissolvable components of the pressure barrier 100 may be selected for operation in a particular pressure and temperature range, or to control the dissolution rate of the pressure barrier 100 or a component thereof.

In some embodiments, the body 110 comprises metallic components which may be made of one or more of: zinc, magnesium, lithium, gallium, aluminum, alloys thereof, or a combination of any of the foregoing. In further embodiments, some or all of the metallic components may be dissolvable when exposed to wellbore fluids. The metallic dissolvable components of the pressure barrier 100 may be at least in part electroplated or otherwise coated with one or more low activity metals, such as gold, platinum, copper, silver, and the like, to protect them from wellbore fluids. Further, the presence of low activity metals helps accelerate the electrochemical dissolution of the metallic dissolvable components when the dissolution process is triggered.

The power source 177 comprises one or more of a battery, a capacitor, and an electrochemical cell. In some embodiments, power source 177 has a potential of approximately ±1.5 V, based on the equilibrium potential calculated by the Nernst equation for a metal and a solution of its ion or other ways of determining potential as known to those skilled in the art.

The connector 176 of the pressure barrier 100 is made of electrically conductive materials, such as a magnesium alloy, an aluminum alloy, or a combination thereof. The connector 176 has two positions: a first position (FIG. 1A) and a second position (FIG. 1B). The connector 176 is configured to fluidly seal the power source 177 from wellbore fluids in both the first and second positions. Further, the connector 176 is electrically connected to the casing 180 and the metallic components of the pressure barrier in both the first and second positions.

In the first position, the connector is spaced apart from, and not in physical contact with, the power source 177. In the first position, the connector 176 is electrically insulated from the power source 177. The connector 176 is configured to shift to the second position when the pressure on the pressure barrier exceeds a predetermined load. For example, the predetermined load may range from about 100 lbs to about 500 lbs.

When the pressure above the pressure barrier 200 exceeds the predetermined load, the connector 176 shifts to the second position, wherein the connector 176 comes into direct contact with the power source 177. The physical contact between the connector 176 and the power source 177 electrically connects the two components and the voltage provided by the power source 177 creates a live electric circuit comprising the power source 177, the connector 176, the casing 180, and the metallic components of the pressure barrier 100. The connector 176 acts as one pole of the electric circuit, while the metallic components act as the other pole.

In operation, the pressure barrier 100 is run downhole with the connector 176 in the first position. When the pressure barrier 100 is in place and set, wellbore operations are performed. In embodiments, the connector 176 remains in the first position during the wellbore operations. When the sealing function of the pressure barrier 100 is no longer required, the dissolution process of the pressure barrier 100 may be selectively initiated by applying fluid pressure to the pressure barrier by pressuring up the wellbore 120. When the pressure on the pressure barrier 100 is above the predetermined load, the connector 176 shifts into the second position to electrically connect with the power source 177, thereby completing the electric circuit with the connector 176 as one pole and the metallic components of the pressure barrier 100 as the other pole.

Aided by the low activity metal plating or coating of some or all of the metallic dissolvable components of the pressure barrier 100, the voltage provided by the power source 177 creates an electrolytic reaction (i.e., an anodic process) in the presence of the wellbore fluids. The electrolytic reaction accelerates the degradation of the metallic dissolvable components, thus allowing the metallic dissolvable components to corrode faster than they would without the power source.

The above-described electrolytic reaction is the opposite of a conventional electroplating operation, such as a chrome plating process wherein the chrome is in solution and, when an electric current is applied to the solution, the chrome comes out of solution and deposits on to the surface of an item to be plated. In the electrolytic process described herein, the electric current of the electric circuit drives the metallic dissolvable components into ion form and into solution in the wellbore fluids, thereby accelerating the degradation process of the metallic dissolvable components and thus speeding up the removal of the pressure barrier 100.

Figure 2:
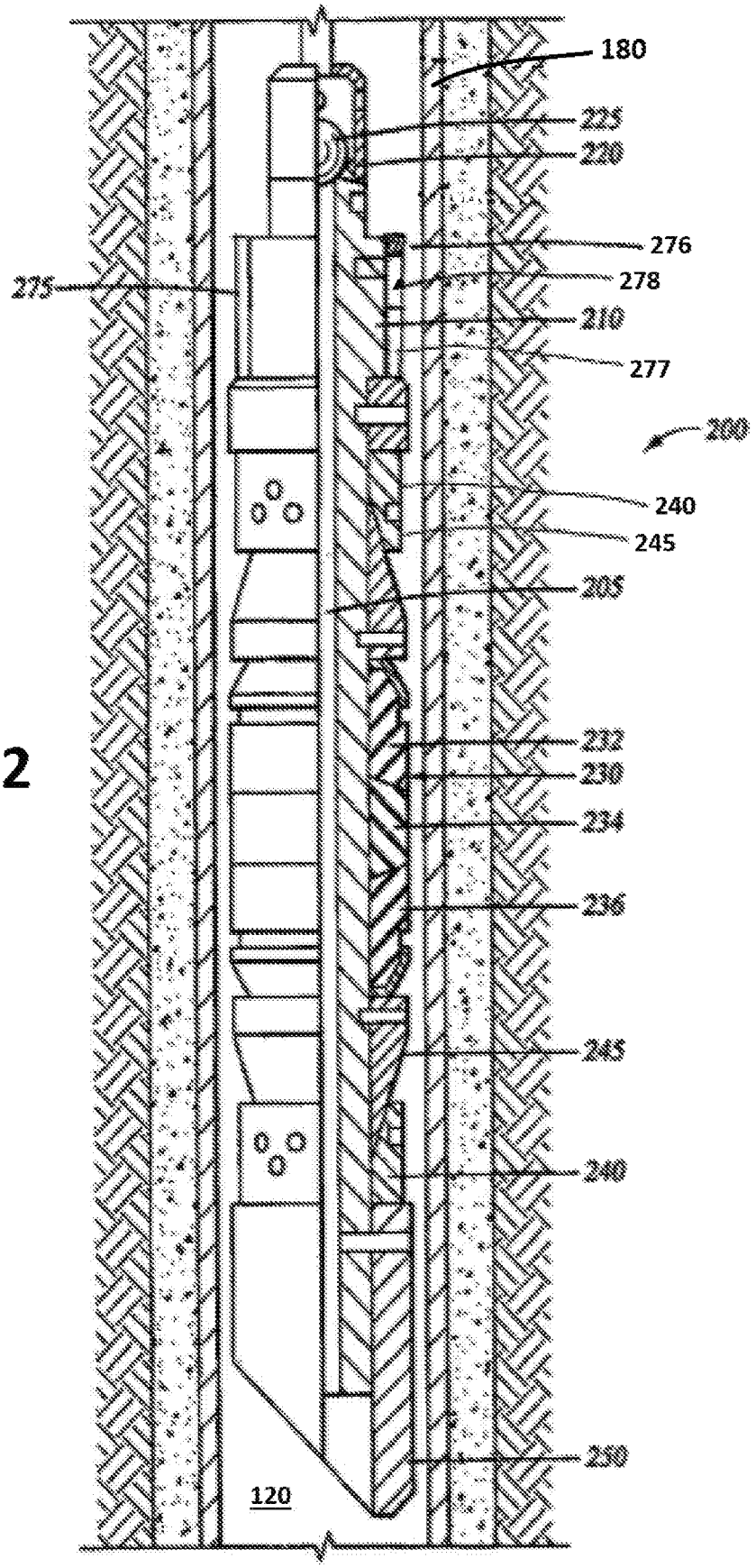
FIG. 2 is a partial-cross sectional side view of a pressure barrier according to another embodiment of the present disclosure.

With reference to FIG. 2, a sample pressure barrier 200 according to one embodiment comprises an elongated tubular body member 210 having an axial bore 205 extending therethrough. A cage 220 is formed at the upper end of the body member 210 for retaining a ball 225 that acts as a one-way check valve. In particular, the ball 225 seals off the bore 205 to prevent flow downwardly therethrough but permits flow upwardly through the bore 205. In some embodiments, other one-way check valves known to a person skilled in the art may be used. A packer element assembly 230, which may comprise an upper sealing element 232, a center sealing element 234, and a lower sealing element 236, extends around the body member 210.

One or more slips 240 are mounted around the body member 210 below the packer assembly 230. The slips 240 are guided by a mechanical slip body 245. A tapered shoe 250 is provided at the lower end of the body member 210 for guiding and protecting the frac plug 200 as it is lowered into the wellbore 120.

The pressure barrier 200 comprises a housing 275 defining a cavity 278 therein for storing a power source 277. The housing 275 is mounted on the body member 210 or may be formed integrally therein. Power source 277 is the same or similar to power source 177 as described above with respect to FIGS. 1A and 1B.

In some embodiments, sealing elements 232, 234 and 236 may be comprised of dissolvable materials such as polylactic acid, polyvinyl acetate, plant starch, low molecular weight polymers that dissolve when exposed to wellbore fluids, or the like, or a combination of any of the foregoing. Aside from the sealing elements of the pressure barrier, various components of the pressure barrier such as slips 240, slip body 245 and shoe 250, and tubular body 210 may comprise metallic dissolvable components, which may further be at least in part electroplated or otherwise coated with one or more low activity metals.

In the illustrated embodiment, the connector of the pressure barrier 200 is a sealing member 276. Like connector 176, the sealing member 276 is made of electrically conductive materials. The sealing member 276 has two positions: a first position and a second position. The sealing member 276 is configured to fluidly seal the power source 277 from wellbore fluids in both the first and second positions. Further, the sealing member 276 is electrically connected to the casing 180 and the metallic components (such as body 210, slips 240, slip body 245, and shoe 250) of the pressure barrier 200 in both the first and second positions.

In the first position, the sealing member 276 is spaced apart and physically separated from the power source 277 and the sealing member fluidly seals against the body 210 to prevent fluids from entering the cavity 278. In the first position, the sealing member 276 is electrically insulated from the power source 277. The sealing member 276 is configured to shift to the second position when the pressure on the pressure barrier 200 exceeds a predetermined load. In the first position, the sealing member 276 is held in place by a retaining mechanism, for example shear pins or other mechanisms known to those skilled the art, that is configured to fail at the predetermined load. For example, the predetermined load may range from about 100 lbs to about 500 lbs. Once the retaining mechanism fails, the sealing member 276 can shift to the second position.

When the pressure above the pressure barrier 200 exceeds the predetermined load, the retaining mechanism fails and the sealing member 276 shifts downhole to the second position and contacts the power source 277. The physical contact between the sealing member 276 and the power source 277 electrically connects the two and completes an electric circuit comprising the power source 277, the sealing member 276, the casing 180, and the metallic components of the pressure barrier 200. The sealing member 276 acts as one pole of the electric circuit, while the metallic components of the pressure barrier 200 act as the other pole.

In operation, the pressure barrier 200 is run downhole with the sealing member 276 in the first position. When the pressure barrier 200 is in place and set, wellbore operations are performed. In some embodiments, the sealing member 276 remains in the first position during the wellbore operations. When the sealing function of the pressure barrier 200 is no longer required, the dissolution process of the pressure barrier may be selectively initiated by applying fluid pressure to the pressure barrier by pressuring up the wellbore 120. When the pressure on the pressure barrier 200 is above the predetermined load, the retaining mechanism holding the sealing member 276 in place fails and the wellbore pressure displaces the sealing member 276 downward into the second position to contact the power source 277 to thereby complete the electric circuit with the sealing member as one pole and the remaining metallic components of the pressure barrier 200 as the other pole.

The dissolution process of the pressure barrier 200 is aided by the low activity metal plating or coating of some or all of the metallic dissolvable components thereof, as described above with respect to pressure barrier 100.

Interpretation of Terms

Unless the context clearly requires otherwise, throughout the description and the "comprise", "comprising", and the like are to be construed in an inclusive sense, as opposed to an exclusive or exhaustive sense; that is to say, in the sense of "including, but not limited to"; "connected", "coupled", or any variant thereof, means any connection or coupling, either direct or indirect, between two or more elements; the coupling or connection between the elements can be physical, logical, or a combination thereof; "herein", "above", "below", and words of similar import, when used to describe this specification, shall refer to this specification as a whole, and not to any particular portions of this specification; "or", in reference to a list of two or more items, covers all of the following interpretations of the word: any of the items in the list, all of the items in the list, and any combination of the items in the list; the singular forms "a", "an", and "the" also include the meaning of any appropriate plural forms.

Where a component is referred to above, unless otherwise indicated, reference to that component should be interpreted as including as equivalents of that component any component which performs the function of the described component (i.e., that is functionally equivalent), including components which are not structurally equivalent to the disclosed structure which performs the function in the illustrated exemplary embodiments.

The previous description of the disclosed embodiments is provided to enable any person skilled in the art to make or use the present invention. Various modifications to those embodiments will be readily apparent to those skilled in the art, and the generic principles defined herein may be applied to other embodiments without departing from the spirit or scope of the invention. Thus, the present invention is not intended to be limited to the embodiments shown herein, but is to be accorded the full scope consistent with the claims, wherein reference to an element in the singular, such as by use of the article "a" or "an" is not intended to mean "one and only one" unless specifically so stated, but rather "one or more". All structural and functional equivalents to the elements of the various embodiments described throughout the disclosure that are known or later come to be known to those of ordinary skill in the art are intended to be encompassed by the elements of the claims. Moreover, nothing disclosed herein is intended to be dedicated to the public regardless of whether such disclosure is explicitly recited in the claims. It is therefore intended that the following appended claims and claims hereafter introduced are interpreted to include all such modifications, permutations, additions, omissions, and sub-combinations as may reasonably be inferred. The scope of the claims should not be limited by the preferred embodiments set forth in the examples, but should be given the broadest interpretation consistent with the description as a whole.

What is claimed is:

1. A method for dissolving at least a part of a pressure barrier in a wellbore having a casing, the pressure barrier comprising a power source and one or more metallic dissolvable components, the method comprising:

applying a pressure to the pressure barrier to form an electric circuit comprising the one or more metallic dissolvable components, the power source, and the casing; and applying a voltage, by the power source, across the casing and the pressure barrier.

2. The method of claim 1 wherein the pressure barrier comprises a connector, and wherein applying the pressure to the pressure barrier shifts the connector from a first position, wherein the connector is electrically insulated from the power source, to a second position, wherein the connector is in electrical communication with the power source, the one or more metallic dissolvable components, and the casing.

3. The method of claim 2 wherein the connector is held in place by a retaining mechanism that fails upon application of a predetermined load thereon and the pressure is the same or greater than the predetermined load.

4. The method of claim 3 wherein the predetermined load ranges from 100 lbs to 500 lbs.

5. The method of claim 1 wherein at least one of the one or more metallic dissolvable components is coated with a metal, wherein applying the pressure comprises introducing a fluid into the wellbore, and wherein applying the voltage causes an electrolytic reaction between the one or more metallic dissolvable components and the metal in the presence of the fluid.

6. The method of claim 1 comprising delaying application of the voltage for a predetermined amount of time.

7. The method of claim 1 comprising releasing, by the pressure barrier, a corrosive agent.

8. The method of claim 1 wherein the voltage is between about 1 volt and 5 volts.

9. A pressure barrier for downhole operations comprising:

a body having a metallic dissolvable component;

a power source;

a connector, the connector being conductive and electrically connected to the metallic dissolvable component, the connector configured to fluidly seal the power source from downhole fluids, and the connector having:

a first position, wherein the connector is electrically insulated from the power source; and a second position, wherein the connector is in electrical communication with the power source; and wherein the connector is shiftable from the first position to the second position when a pressure above a predetermined load is applied to the pressure barrier.

10. The pressure barrier of claim 9 wherein at least a part of an outer surface of the metallic dissolvable component is coated with a metal capable of reacting electrolytically with the metallic dissolvable component for accelerating degradation of the metallic dissolvable component.

11. The pressure barrier of claim 10 wherein the metal comprises gold, platinum, copper, silver, or a combination thereof.

12. The pressure barrier of claim 9 comprising a retaining mechanism for maintaining the connector in the first position and the retaining mechanism is configured to fail when the pressure is above the predetermined load.

13. The pressure barrier of claim 9 wherein the metallic dissolvable component comprises one or more of: zinc, magnesium, lithium, gallium, aluminum, and an alloy thereof.

14. The pressure barrier of claim 9 wherein the connector comprises a magnesium alloy, an aluminum alloy, or a combination thereof.

15. The pressure barrier of claim 9 wherein the power source comprises one or more of a battery, a capacitor, and an electrochemical cell.

16. The pressure barrier of claim 9 comprising slips, a slip body, and a shoe, wherein at least one of the slips, slip body, and shoe comprises the metallic dissolvable component.

17. The pressure barrier of claim 9 comprising a bladder having a corrosive agent therein and configured to release the corrosive agent when the connector is in the second position.

18. The pressure barrier of claim 9 wherein the connector is a sealing member, wherein in the first position, the sealing member is physically separated from the power source and in the second position, the sealing member is shifted downward to be in physical contact with the power source.

* * * * *